US011510004B1

(12) United States Patent
Van Schyndel

(10) Patent No.: US 11,510,004 B1
(45) Date of Patent: Nov. 22, 2022

(54) TARGETED DIRECTIONAL ACOUSTIC RESPONSE

(71) Applicant: Ford Global Technologies, LLC, Dearborn, MI (US)

(72) Inventor: Andre John Van Schyndel, Kanata (CA)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/465,385

(22) Filed: Sep. 2, 2021

(51) Int. Cl.
*H04R 3/12* (2006.01)
*H04R 29/00* (2006.01)
*H04R 1/40* (2006.01)

(52) U.S. Cl.
CPC ..... *H04R 3/12* (2013.01); *H04R 1/403* (2013.01); *H04R 29/002* (2013.01); *H04R 2201/401* (2013.01); *H04R 2499/13* (2013.01)

(58) Field of Classification Search
CPC ..... H04R 3/12; H04R 1/403; H04R 29/002; H04R 2201/401; H04R 2499/13; H04S 3/02; H04S 7/302
See application file for complete search history.

(56) References Cited

U.S. PATENT DOCUMENTS 8,295,500 B2 * 10/2012 Shin ..... H04R 1/403 381/59
9,392,390 B2 * 7/2016 Olsen ..... H04S 7/30
11,246,000 B2 * 2/2022 Widmark ..... H04S 7/30
2014/0348354 A1 * 11/2014 Christoph ..... H04R 29/001 381/303
2015/0264510 A1 * 9/2015 Jin ..... H04S 7/30 381/303

(Continued)

FOREIGN PATENT DOCUMENTS

CN 110446136 B 7/2020
EP 3486121 A1 5/2019

(Continued)

OTHER PUBLICATIONS

Terence Betlehem et al, "Personal Sound Zones: Delivering interference-free audio to multiple listeners", IEEE Signal Processing Magazine, Mar. 2015, 11 pages.

*Primary Examiner* — Jason R Kurr
(74) *Attorney, Agent, or Firm* — Frank Lollo; Eversheds Sutherland (US) LLP

(57) ABSTRACT

A method for delivering an optimized acoustic signal to a targeted sound field includes determining a bright zone having a high acoustic energy sound delivery region and a dark zone having low acoustic energy sound delivery region. The system selects a finite impulse response (FIR) filter set associated with a plurality of loudspeakers, and generates, via the plurality of loudspeakers and based on the FIR filter set, an acoustic signal having a sound pressure due to the combined loudspeakers (p) at an observation point r in a sound field disposed in the bright zone. The acoustic signal is delivered such that the sound pressure due to the combined loudspeakers at the observation point is approximately equal to unity acoustic energy at the observation point when the sound pressure due to the combined loudspeakers is generated via a single loudspeaker of the plurality of loudspeakers, and the remaining loudspeakers of the plurality of loudspeakers are off.

20 Claims, 4 Drawing Sheets

(56) References Cited

U.S. PATENT DOCUMENTS

| | | | | |
|---|---|---|---|---|
| 2017/0201848 | A1* | 7/2017 | Cai | H04R 29/002 |
| 2018/0027350 | A1* | 1/2018 | Buerger | H04S 7/302 381/303 |
| 2018/0146290 | A1* | 5/2018 | Christoph | H04R 3/04 |
| 2021/0380055 | A1* | 12/2021 | Kim | B60R 16/023 |
| 2022/0068253 | A1* | 3/2022 | Pignier | H04S 7/302 |

FOREIGN PATENT DOCUMENTS

| | | | |
|---|---|---|---|
| KR | 101428108 | B1 | 8/2014 |
| WO | 2018106163 | A1 | 6/2018 |

* cited by examiner

TARGETED DIRECTIONAL ACOUSTIC RESPONSE

TECHNICAL FIELD

The present disclosure relates to acoustic sound zones, and more particularly, to targeted directional acoustic response systems providing personal sound zones.

BACKGROUND

Targeted directional acoustic response delivers an acoustic signal that seems, to a listener in one part of the sound delivery region, originate from a particular direction or position, while at the same time seems quiet or inaudible to a second listener in another part of the sound delivery region. When used in a passenger vehicle, such technology becomes useful when one or more passengers wish to hear an audio feed (music, audio book, etc.) while other passengers wish to remain in silence or enjoy their own entertainment.

Recent advancements in acoustic targeted directivity generate acoustic target areas having both quiet regions and loud regions. Regions with quiet or inaudible sound as perceived by a listener, are referred to in the present disclosure as dark zones. Dark zones may have inaudible acoustics or have a low sound pressure amplitude when compared with regions having respectively higher sound pressure amplitudes. Regions of a sound delivery region having higher targeted directional sound pressure are referred to herein as bright zones.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
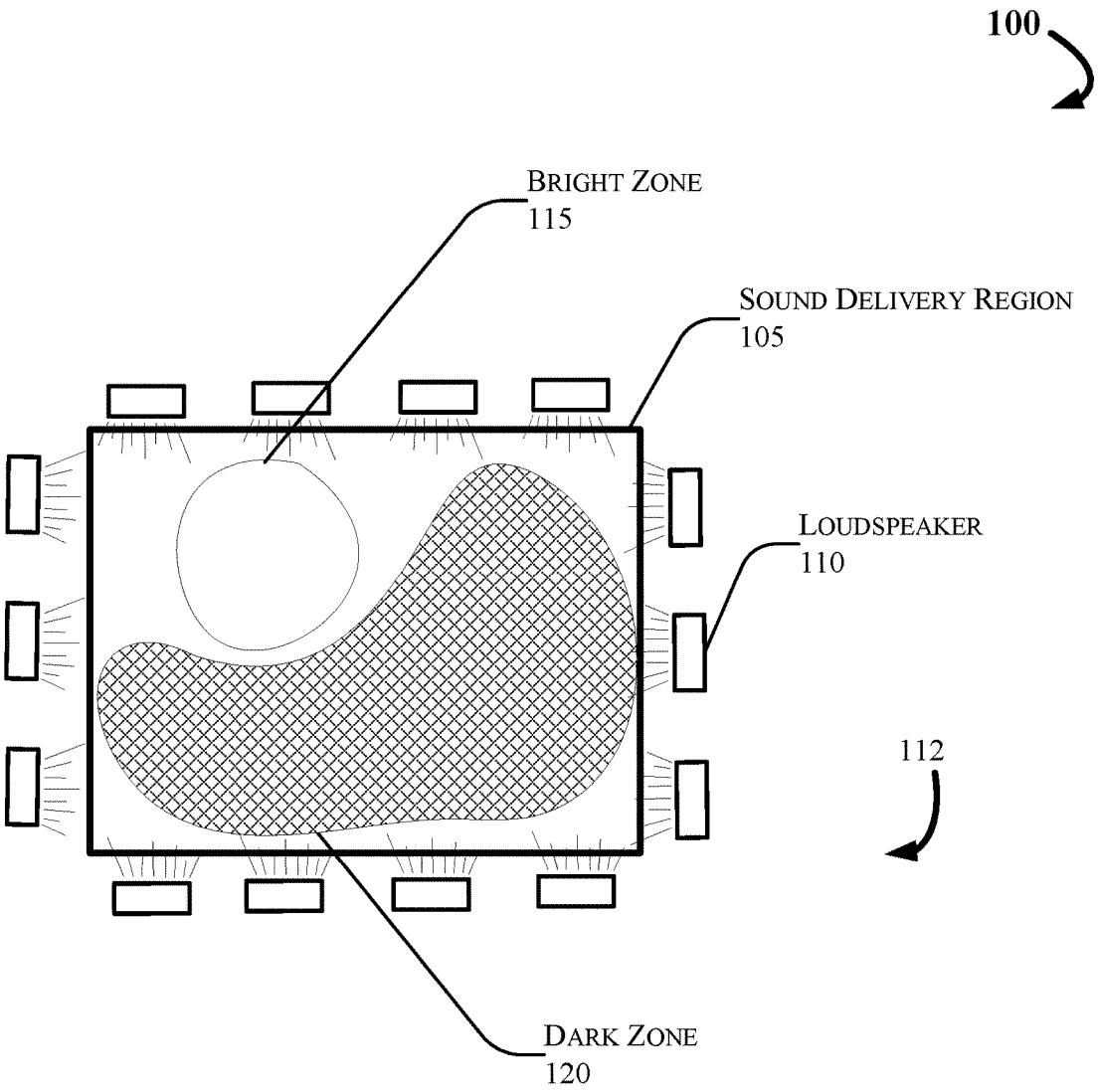
FIG. 1 depicts a targeted sound field system in accordance with the present disclosure.

The systems and methods disclosed herein are configured and/or programmed to provide an optimized targeted sound delivery region that includes a bright zone with higher sound pressure due to the combined loudspeakers such that a listener in the bright zone can hear acoustics delivered using the system, while at the same time a listener localized in a dark zone of the optimized targeted sound field will receive little or no sound. To the listener or observer in one part of a sound delivery region, the sound may seem to originate from a desired location. Aspects of the present disclosure describe systems and methods for generating optimized directional sound that gives the listener the experience of hearing audio that originates from a chosen single loudspeaker, although all loudspeakers disposed in and around the sound delivery region may be used in concert to produce the effect.

According to another aspect of the present disclosure, the targeted directional acoustic response system may be applicable to a vehicle sound system that includes a one or more bright zones where the produced sound is louder (for example, driver's seat) and one or more dark zones where the produced sound is quieter (for example, a passenger's seat).

Conventional approaches may optimize acoustic energy in the bright and dark zones by defining acoustic energy received at all points within the sound field mathematically (e.g., using orthogonal basis expansion or other similar methods). Moreover, conventional systems may require precise tracking and observation of the head position of the listener within the sound delivery region for selection of respective filters required to produce the desired bright and dark zone effects.

According to one or more embodiments, the targeted directional acoustic response system may optimize the target sound field (e.g., the bright region within which an observer can hear targeted or untargeted acoustics) by maximizing a difference of the bright zone acoustic energy and the dark zone acoustic energy. This approach can include determining the loudspeaker gains that correspond to the sound field in the bright zone, determining the loudspeaker gains in the dark zone, and maximizing the difference between bright zone energy and dark zone energy using a new Lagrangian.

According to one or more embodiments, the targeted sound field system 100 may form a modified bright zone transimpedance matrix by redefining some of its elements and using the modified version to calculate the optimal loudspeaker filters that would produce the desired bright and dark zones. In some aspects, the targeted sound field system 100 may optimize the differential value using one or more standard methods such as eigenvalue decomposition.

Aspects of the present disclosure may provide optimized targeted sound fields and dark zones in an enclosed space sound delivery region such as the cabin of a vehicle, where multiple bright zones and dark zones may be defined using a simplified algorithmic approach. Unlike conventional systems, the listener may not lose acoustic directivity that provides the effect of hearing sound origination from a desired direction by simply changing their head position. Rather, the listener or observer may experience sound directivity in the bright zone without the need of head tracking or ear tracking.

These and other advantages of the present disclosure are provided in greater detail herein.

Illustrative Embodiments

The disclosure will be described more fully hereinafter with reference to the accompanying drawings, in which example embodiments of the disclosure are shown, and not intended to be limiting.

Conventional systems may use acoustic wave cancellation in quiet areas. Such systems may be limited because relatively small movements of the listener place their ears in a location having a different phase of sound transmission, which may change the acoustic amplitude cancellation in the moved position to cancel the sound less than the initial position.

Directional sound is perceivable by the listener as originating from one direction or location. Providing this capability could be used in conjunction with surround sound technologies used in entertainment and other sound delivery systems. Conventional approaches to targeted sound may generate both bright zones and dark zones in a targeted acoustical region, but remain unable to create the audible impression of directional sound without precise head tracking of the listener in the bright zone. Additionally, conventional approaches to targeted directional acoustics may produce a sound field (e.g., bright region) without control of the amplitude in the bright region such that the listener is able to change position within the bright region retaining continuity of the desired acoustic amplitude.

Head tracking often includes tracking the listener's head and ear position using cameras or other sensory devices, which often require significant hardware and sensory processing resources. Without head tracking, conventional systems may not deliver sound directionality for the listener positioned in a bright zone. Other approaches may include signal processing techniques such as the implementation of HRTFs (Head Related Transfer Functions) that create the experience of movement of the point of sound origination based on signal response at the points of respective ears of the listener. HRTF techniques often require substantial head tracking and digital signal processing resources. Bright zones that are optimized based on energy have frequency and spatial dependencies. This means that there is no equalization that would work for all parts of the bright zone or all frequencies using conventional systems. Known techniques can produce directional sound in a bright zone by using an orthogonal basis expansion. However, these methods require a preselection of these orthogonal basis functions, and they may not be optimum for the application. The present method does not require preselection of orthogonal basis functions.

It may be advantageous to provide a system that generates consistent amplitude and directional acoustics in a defined bright zone, providing sound that seems to originate from a single loudspeaker regardless of the position of the listener within the bright zone, although all loudspeakers in the targeted sound field system 100 may be used to produce the bright and dark zone acoustics. It is also advantageous to obtain the solution without needing to use an orthogonal basis expansion. This technique allows a construction of the spatial response in the bright zone to which equalization can be applied in various traditional manners. At the same time, the system may provide low amplitude sound to the defined dark zone (e.g., having a sound pressure due to the combined loudspeakers that approaches 0), while still being proximate to the bright zone.

It is also advantageous to provide directional sound that changes loudspeakers such that the listener experiences the impression of a particular sound origination. For example, ICC (In Car Communication) implementations could deliver sound that seems to come from the person who is speaking. Embodiments of the present disclosure describe a system and methods for delivering targeted sound that seems to come from a single position, while the sound delivered to other passengers can be significantly reduced in acoustic level (amplitude).

FIG. 1 depicts a targeted sound field system 100, in accordance with the present disclosure. The targeted sound field system 100 can include a sound delivery region 105, which may be an enclosed or unenclosed space such as a vehicle cabin, a large room, etc. Although depicted in FIG. 1 as generally rectangular in shape, it should be appreciated that the sound delivery region may include any geometry according to the desired application. The targeted sound field system 100 may include a plurality of loudspeakers 112 disposed at various points of the periphery of the sound delivery region 105. In some aspects, the loudspeaker locations are not limited to a particular count of sources (e.g., more or less than the 14 total loudspeakers depicted in FIG. 1), and are not limited to positions at the periphery of the sound delivery region(s). For example, one or more of the plurality of loudspeakers 112 may be disposed at an interior position of the sound delivery region 105, and may be located anywhere in 3-dimensional (3D) space.

The sound delivery region 105 can include one or more bright zones 115 and one or more dark zones 120. It should be appreciated that the relative size, shape, and position of the bright zone 115 and the dark zone 120 are provided for descriptive purposes only and should not be considered to be limiting in any way.

Acoustic energy in any region within the sound delivery region 105 may be defined by breaking up respective zones of the bright zone 115 and the dark zone 120 into small pieces or regions, The plurality of loudspeakers 112, includes multiple loudspeakers such as the loudspeaker 110. Determining the acoustic energy in the bright zone 115 and/or the dark zone 120 may be defined in terms of acoustic pressure at positions (point $r_i$) of the observer (or hearer) and the volume velocity of the loudspeaker. This relationship, characterized between each loudspeaker and each point $r_i$ is known as a transimpedance matrix. As a matter of practice, the measurement is usually taken as the frequency response between the pressure at the point $r_i$ and the electrical signal to the loudspeaker.

If all the acoustic pressure in the sound delivery region 105 originates from $N_q$ sources (where $N_q$ represents the plurality of loudspeakers 112), the acoustic pressure at any point $r_i$ can be expressed as a sum over the sources:

$$p(r_i) = \sum_{j=1}^{N_q} z(r_i, r_j) q_j \tag{1}$$

where:

$q_j$ is the volume velocity of the $j^{th}$ source. The volume velocity of the loudspeaker is proportional to the electrical signal applied to it. For simplicity, we will often use this same symbol $q_j$ to represent the electrical gain applied to the $j^{th}$ loudspeaker by its corresponding loudspeaker filter.

$r_i$ is the location of the $i^{th}$ observation point;

$r_j$ is the location of the $j^{th}$ source; and $z(r_i, r_j)$ is transfer impedance between the $i^{th}$ observer location and the $j^{th}$ source location. The transfer impedance relates a volume of air coming from the loudspeaker to a pressure observed at the observer point $r_i$, such as a position in the bright zone.

Figure 2:
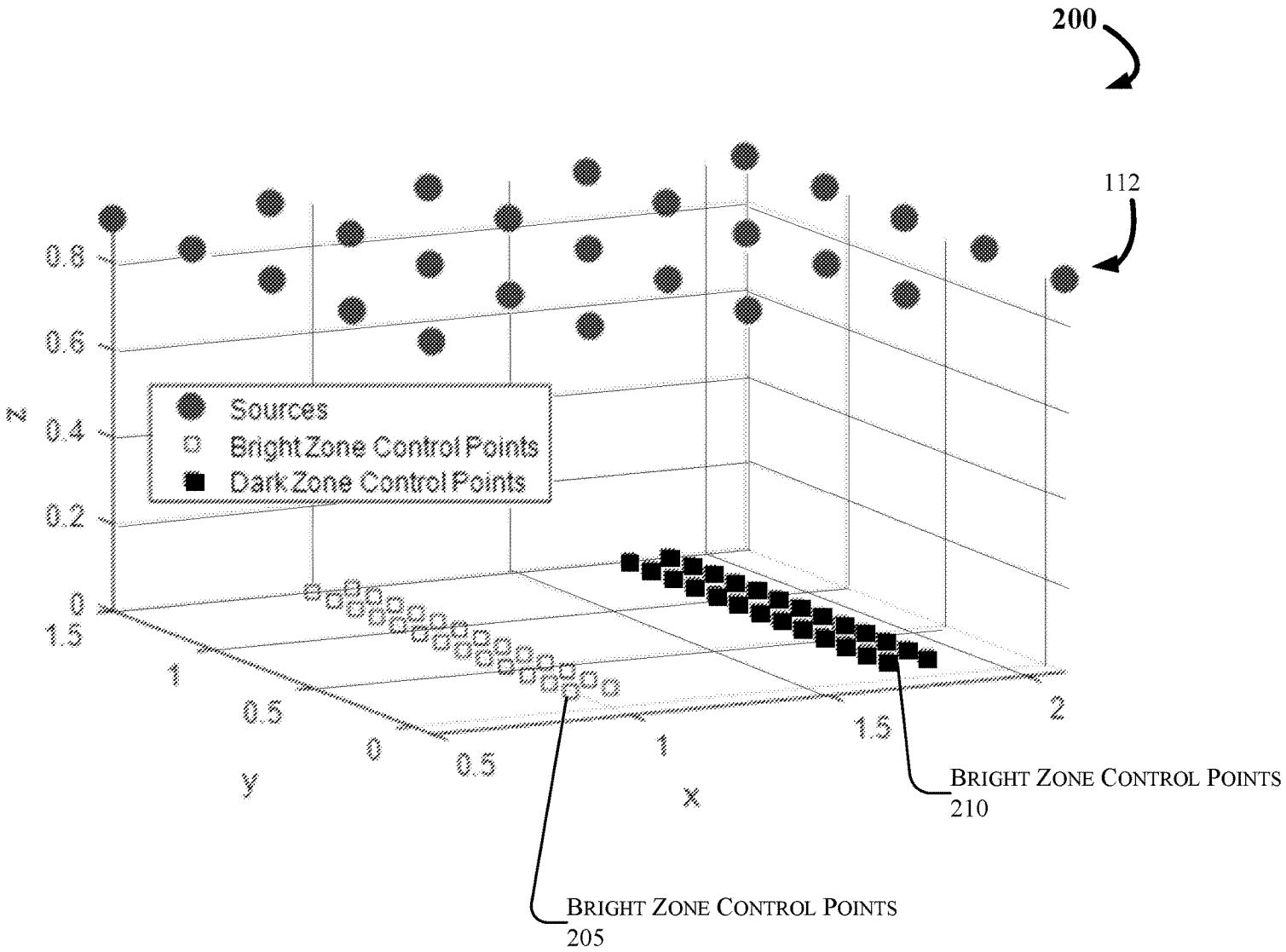
FIG. 2 depicts an example of a physical implementation for which techniques and structures for providing the systems and methods disclosed herein may be implemented.

FIG. 2 illustrates a 3-dimensional graph 200, in accordance with one or more embodiments. In some aspects, defining $p(r_i)$ may include segmenting the bright zone 115 and the dark zone 120 (as shown in FIG. 1) into $N_c$ pieces small enough that the pressure p does not change substantially within the segmented portion. For example, a segment may be one $cm^3$, 8 $cm^3$, 10 $cm^3$, etc. As shown in FIG. 2, the control points 205 and 210 are positioned in 3-D space within the bright zone 115 and the dark zone 120, respectively.

The pressure p may therefore be expressed within each of these theoretical segments as equal to the pressure p at a centroid of each respective segment. These centroids are referred to herein as control points, which are illustrated in FIG. 2. The pressure p defines the pressure with respect to one or more sample position in the sound delivery region comprising all points $r_i$, where each point r is theoretically at the centroid of the control points 205 and 210, respectively. Accordingly, q may be defined as an $N_q$ element (column) vector whose elements are the electrical gains applied by the loudspeaker filters $q_j$. For example, referring again to FIG. 1, the gain applied by the loudspeaker filter corresponding to loudspeaker 110 may be uniquely defined as $q_k$ where k is the ordinal number corresponding to loudspeaker 110 the particular one of the 14 shown loudspeakers of the plurality of loudspeakers 112.

The term Z is defined as an $N_c \times N_q$ matrix whose elements are $Z_{ij}=z(r_i, r_j)$, each element defining transfer impedance between the $i^{th}$ observer location and the $j^{th}$ source location.

The term p is defined as an $N_c$ element (column) vector having vector elements that include the pressures $p(r_i)$.

Accordingly, the sound field at any position in the bright zone 115 may be characterized as having a pressure p. such that, $$p=Zq \tag{2}$$

It should be appreciated that the value q is linearly associated (or approximately linearly associated) to an input voltage provided to a respective loudspeaker (e.g., an $N_q$ source). Defining discrete pressures within the bright zone 115 provides a determinable total energy E that may be defined as an integral where $$E = \int_{V_b} p(r)^* p(r) dV. \tag{3}$$

The energy integral of Equation (3) may provide a mathematical model for determining the total acoustic energy in the bright zone 115. As explained above, the bright zone 115 may be a high acoustic energy sound delivery region within which sound is hearable by a listener (listener not shown in FIG. 1 or 2) positioned within the bright zone 115. The dark zone 120 is a low acoustic energy sound delivery region where the listener, ideally, would hear little or no sound within that region. Accordingly, the Equations (1), (2), and (3) may also be usable to determine the total acoustic energy in the dark zone 120.

With an assumption that the volume of each the $N_c$ segmented portions are equal, the volume integral over the bright zone 115 can be written as a sum over the control points 205, 210, as:

$$E = \int_{V_b} p(r)^* p(r) dV = p^H p = (Zq)^H Zq = q^H Z^H Zq \tag{4}$$

where $p^H$ is the conjugate transpose (a.k.a "Hermitian conjugate") of p.

By forming a similar matrix for the dark zone 120, the corresponding transfer impedance matrices may be denoted as $Z_B$ and $Z_D$, respectively. We can now define the acoustic energy $E_B$ in the bright zone 112 as:

$$E_B=q^H Z_B{}^H Z_B q \tag{5}$$

Similarly, the acoustic energy in the dark zone 120 may be defined as:

$$E_D=q^H Z_D{}^H Z_D q \tag{6}$$

Conventional approaches to defining acoustic energy $E_B$ in the bright zone 115 and $E_D$ in the dark zone 120 may include defining acoustic energy received at all control points 205, 210 within the sound delivery region 105, for all frequencies. They may also minimize the difference between the loudspeaker electrical drive energy ($q^H q$) and some constant value ($E_q$). Some recent conventional approaches use, for example, orthogonal basis expansion to obtain solutions. The necessity to define an "orthogonal basis" is an added step for which there is no completely defined method. It may therefore not result in an optimum solution. Further, new implementations may require a redefinition of these "orthogonal basis functions."

A useful application in conventional systems, may also require precise tracking and observation of the head position of the listener within the sound delivery region, which tracks $z(r_i, r_j)$ as the listener's ears move within the sound delivery region 105.

However, rather than maximize the acoustic energy in the bright zone 115 ($q^H Z_B{}^H Z_B q$), the targeted sound field system 100 may minimize the acoustic energy derived from a redefined transimpedance matrix Y, which redefines ($q^H Z_B{}^H Z_B q$). This step may minimize the difference between the sound field in the bright zone 115 and the desired sound field in the bright zone.

According to one or more embodiments, and as shown in Equation (7), the system may produce a more elegant solution by generating a new bright zone transimpedance matrix $Y_B$ that can be defined as having elements expressed as a difference between the original $Z_B$ and $q_s$, where, $$Y_{Bij}=Z_{Bij}-q_{sj} \tag{7}$$

Rather than maximize the acoustic energy in the bright zone ($q^H Z_B{}^H Z_B q$), the system 100 minimizes the acoustic energy derived from the redefined transimpedance matrix ($q^H Y_B{}^H Y_B q$). More particularly, according to an embodiment, the targeted sound field system 100 may determine a total acoustic energy in the bright zone, determining a total acoustic energy in the dark zone, divide the total acoustic energy in the bright zone by the total acoustic energy in the dark zone, and optimizing by minimizing a differential value of the first energy and the second energy.

In some aspects, the targeted sound field system 100 may determine the acoustic energy in the bright zone by normalizing a value of acoustic energy in the bright zone, then subtracting from that the energy in the dark zone until a maximum value is determined for that difference of those values. Accordingly, the targeted sound field system 100 may hold constant the energy in the bright zone and minimize the acoustic energy in the dark zone.

According to an embodiment, the targeted sound field system 100 may maximize the desired acoustic energy in the bright zone and minimize the acoustic energy in the dark zone while constraining the power delivered to the loudspeakers by using a Lagrangian multiplier to provide useful and repeatable control of the total power coming from the loudspeakers $q^H q$. A Lagrangian multiplier can be configured to optimize solutions to this problem, where the targeted sound field system 100 adds the constraint of a normalized energy value calculated for the bright zone 115

The desired sound field in the bright zone is set by the value of the matrix $q_s$. The optimized bright zone sound field will be that produced by loudspeakers with amplitudes given by this matrix. For example, one simple approach may include choosing a desired sound field (e.g., the bright zone 115) to be that corresponding to one of the existing loudspeakers (e.g., the $J^{th}$ loudspeaker). The targeted sound field system 100 may then minimize the difference between the energy in the bright zone 115 and the energy due to the $J^{th}$ loudspeaker (energy not shown in FIG. 1). In this way, the targeted sound field system 100 may constrain the apparent source of the sound in the bright zone 115 to originate from any loudspeaker of the plurality of loudspeakers 112. This can be accomplished by setting the loudspeaker gains ($q_s$) to unity for the $J^{th}$ loudspeaker, and all the other elements set to zero as prescribed in Equation.

$$q_{si} = \begin{cases} 1, & \text{for } i = J \\ 0, & \text{otherwise} \end{cases}. \tag{8}$$

Accordingly, the sound pressure due to the combined loudspeakers (e.g., the plurality of loudspeakers 112) at the observation point is approximately equal to a unity acoustic energy at the observation point when the sound pressure due to the combined loudspeakers is generated via a single loudspeaker of the plurality of loudspeakers 112, and the remaining loudspeakers of the plurality of loudspeakers are off.

More specifically, in one or more embodiments, the targeted sound field system 100 may minimize a differential value between the sound field in the bright zone 115 and the sound field from the $J^{th}$ loudspeaker. In this way, the targeted sound field system 100 may constrain the apparent source of the sound in the bright zone to originate from any loudspeaker of the plurality of loudspeakers 112 (e.g., 110 as shown in FIG. 1) that may be desired according to application.

First, total energy may be denoted in the bright zone as $E_{BT}$. An expression for the bright zone energy we wish to minimize by may be defined by subtracting the contribution from the $J^{th}$ loudspeaker to the energy in the bright zone 115, such that $$E_B = q^H Z_B^H Z_B q - q_J^* q_J \sum_{i=1}^{N_c} \frac{1}{V_i} \int_{V_i} z(r_i, r_J)^* z(r_i, r_J) dV. \tag{9}$$

The second term in Equation (9) can be incorporated into the first term if we set the transimpedance matrix to the new transimpedance matrix $Y_B$: the original $Z_B$ matrix with the elements for the $J^{th}$ loudspeaker are set to zero. Equation (8) shows this relationship, $$\mathcal{L} = q^H Y_B{}^H, Y_B q + q^H Z_D{}^H Z_D q + \lambda_q (q^H q - E_q) \tag{10}.$$

The constrained energy value of total power may increase the reliability of output values that drive the plurality of loudspeakers 112, and simplify the computational burden on processing resources because every frequency must not be calculated for every position to accommodate for head movement.

Moreover, Equation (8) demonstrates another aspect of the present disclosure, such that nothing is subtracted from the aggregated pressure (see, for example, Equation (7)). The last term in the Lagrangian utilizes a "Lagrangian Multiplier" ($\Delta_q$) to constrain the power going into the loudspeakers to $E_q$.

We now seek to find the loudspeaker gains q that minimize the Lagrangian in Equation (10). There are several standard methods which can be used. Since the Lagrangian is amenable to eigenvalue decomposition methods, that technique is demonstrated below.

To find the critical points, the targeted sound field system 100 may take the derivatives with respect to gains q, such that $$\frac{\partial \mathcal{L}}{\partial q} = 2Y_B^H Y_B q + 2Z_D^H Z_D q + 2\lambda_q q. \tag{11}$$

The targeted sound field system 100 may next set the derivatives to zero, giving the following eigenvalue Equation (10):

$$\lambda_q q = -[Y_B{}^H Y_B + Z_D{}^H Z_D] q \tag{12}.$$

It should be appreciated by those skilled in the art that Equation (10), when maintained as an eigenvalue equation, allows the targeted sound field system 100 to produce a solution to the Equation reliably and consistently. More particularly, the targeted sound field system 100 may generate extremal solutions given by the eigenvectors of $-[Y_B{}^H Y_B + Z_D{}^H Z_D]$. Accordingly, Equation (10) illustrates how the targeted sound field system 100 may generate a filter set having pre-calculated filters associated with all acoustic frequencies generated by the loudspeakers.

Because the solution contains maxima and minima, we do not know which eigenvalue corresponds to the optimal solution for our problem. However, there are only $N_q$ solutions (or stated in another way, as many solutions as there are loudspeakers in the plurality of loudspeakers 112). Selecting the optimum q from the plurality of solutions available from solving Equation (10) becomes a trivial step for determining a best fit, given any set of requirements. Reasonable criteria for the search could include, for example, the solution that gives the highest average sound level in the bright zone 115 (as expressed in dB), and the highest difference between the bright and dark zone levels in decibels (dB) and how well the pressure in the bright zone fits a waveform transmitted from the desired position. In one embodiment, the criterion is implemented as the sum of the first two quantities.

Figure 3:
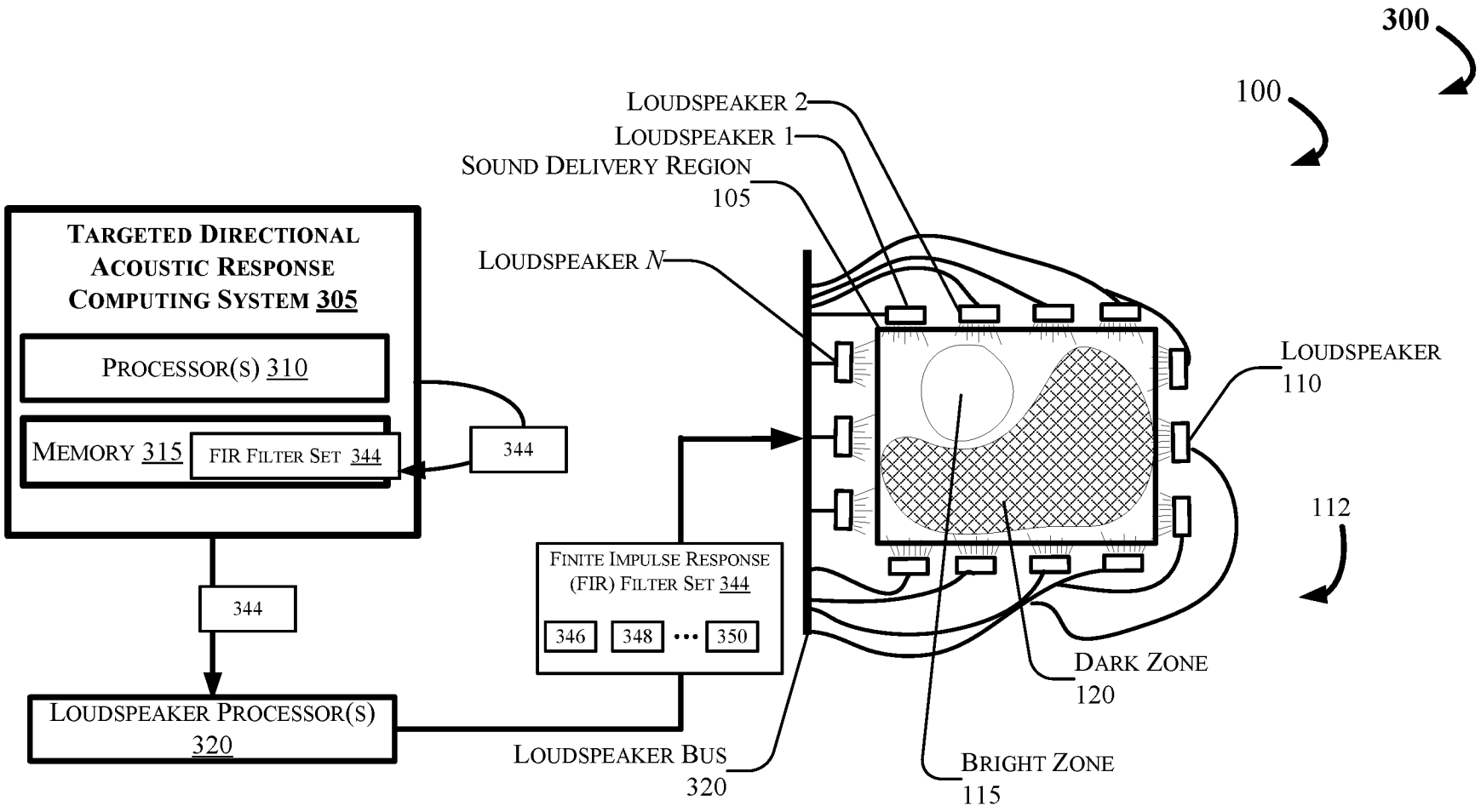
FIG. 3 depicts a targeted directional acoustic response system in accordance with the present disclosure.

FIG. 3 depicts an example computing environment 300 in which techniques and structures for providing the systems and methods disclosed herein may be implemented. The computing environment 300 may include a targeted directional acoustic response computing system 305, which may include one or more processor(s) 310 and a computer-readable memory 315. The targeted directional acoustic response computing system 305 may be disposed in communication with one or more loudspeaker processor(s) 320 programmed and/or configured by the system 305 to generate one or more signals for the plurality of loudspeakers 112. More particularly, the system 100 may be configured and/or programmed to deliver an acoustic signal to the sound delivery region 105 via the loudspeaker processor(s) 320.

The one or more processor(s) 310 may be disposed in communication with one or more memory devices 315 via a loudspeaker bus 320. The processor(s) 310 may utilize the memory 315 to store programs in code and/or to store data for performing aspects in accordance with the disclosure. The memory 315 may be a non-transitory computer-readable memory storing a FIR filter set program code (not shown in FIG. 3) that may be configured and/or programmed to cause the processor(s) 310 to generate one or more FIR filter set(s) 344. For example, the processor(s) 310 may generate the FIR filter set(s) 344, store the set(s) 344 in the persistent memory 315, which may be installed in the loudspeaker processor(s) 320 to cause the processor(s) to generate an acoustic signal via the plurality of loudspeakers 112 and based on the FIR filter set 344. For example, the loudspeaker processor(s) 320 may drive the plurality of loudspeakers 112 using the FIR filter set 344 such that a first FIR filter 346 is used to drive a first Loudspeaker 1, a second FIR filter 348 is used to drive a second Loudspeaker 2 . . . and an Nth FIR filter set 350 is used to drive an Nth loudspeaker (Loudspeaker N) of the plurality of loudspeakers 112, where there are N total loudspeakers in the system 100. According to one or more embodiments, the FIR filter set 344 may include N total filters in the set, where N is equal to a count of loudspeakers in the plurality of loudspeakers 112.

The memory 315 can include any one or a combination of volatile memory elements (e.g., dynamic random access memory (DRAM), synchronous dynamic random-access memory (SDRAM), etc.) and can include any one or more nonvolatile memory elements (e.g., erasable programmable read-only memory (EPROM), flash memory, electronically erasable programmable read-only memory (EEPROM), programmable read-only memory (PROM), etc.

The targeted loudspeaker processor(s) 320 may be installed onboard a vehicle such that the plurality of loudspeakers 112 are disposed in positions within the cabin (not shown in FIG. 3) to produce the acoustic signals described herein.

Figure 4:
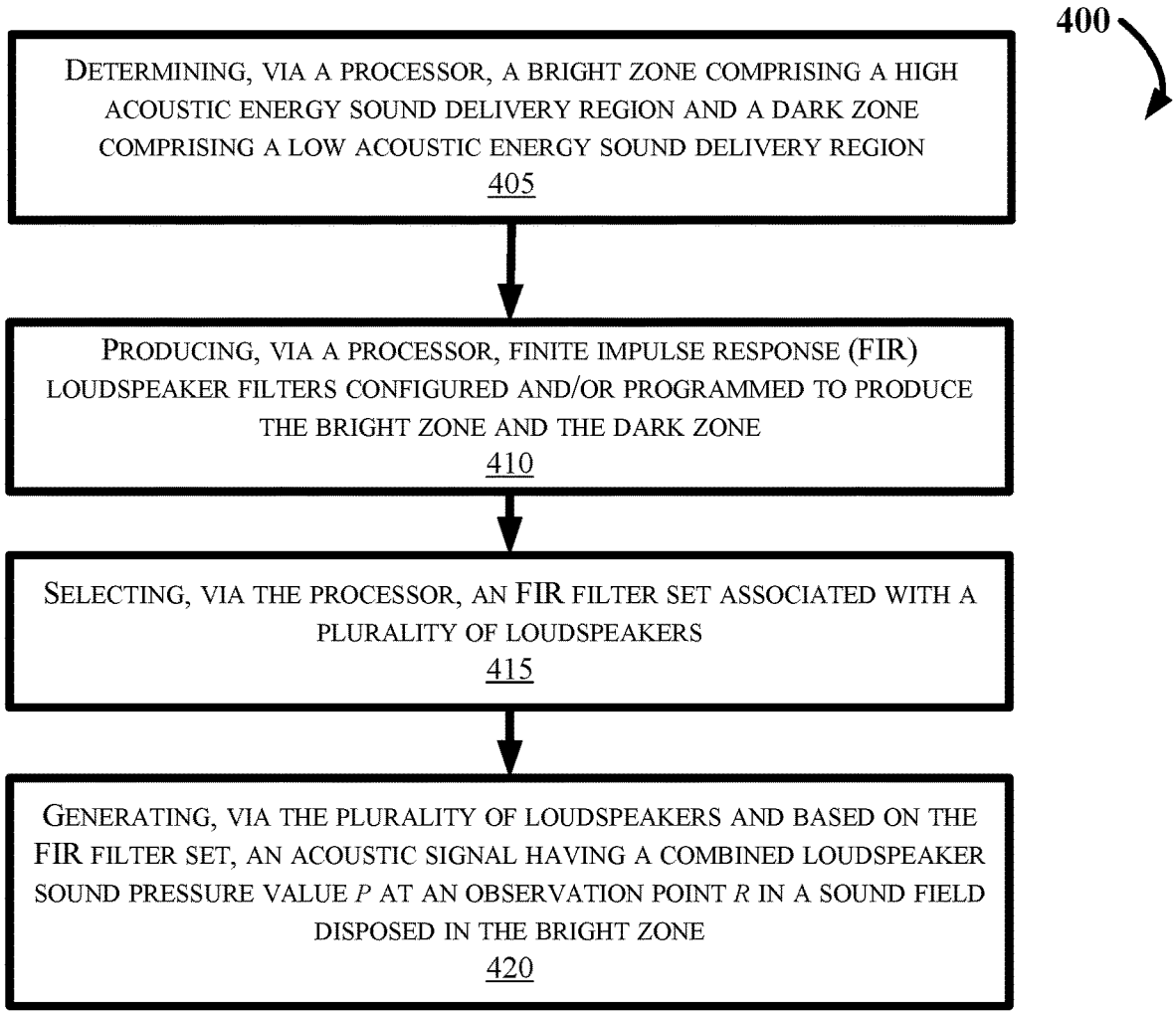
FIG. 4 depicts a flow diagram of an example method for delivering an optimized targeted sound field in accordance with the present disclosure.

FIG. 4 depicts a flow diagram of an example method 400 for delivering an optimized targeted sound delivery region, in accordance with the present disclosure. Referring first to FIG. 4, at step 405, the method 400 may commence with determining, via a processor, a bright zone comprising a high acoustic energy sound delivery region and a dark zone comprising a low acoustic energy sound delivery region.

At step 410, the method 400 may include a step of producing, via a processor, finite impulse response (FIR) loudspeaker filters configured and/or programmed to produce the bright zone and the dark zone.

According to an embodiment, producing the FIR filters may further include the steps of determining a first energy comprising total acoustic energy in the bright zone, determining a second energy comprising total acoustic energy in the dark zone, and minimizing a differential value of the first energy and the second energy.

According to another aspect, producing the FIR filters may omit certain steps known as conventional approaches. For example, the FIR filters, of which may be produced without an orthogonal basis expansion. This step may include producing the FIR filter set by generating a bright zone transimpedance matrix $Y_B$. In some aspects, using the bright zone transimpedance matrix $Y_B$ in the Lagrangian leads to an eigenvalue equation.

According to another aspect, this step may further include determining a first energy comprising total acoustic energy in the bright zone, determining a second energy comprising total acoustic energy in the dark zone, and minimizing a differential value of the first energy and the second energy.

According to another aspect, the bright zone transimpedance matrix $Y_B$ includes a plurality of elements associated with the single loudspeaker. Accordingly, generating the FIR filter set can include minimizing the differential value of the first energy and the second energy using a modified bright zone transimpedance matrix $Y_B$. The modifying steps may include subtracting a matrix $q_s$, forming a Lagrangian that adds the second energy to the first energy, and determining an overall minimum value of the Lagrangian.

According to one or more embodiments, the plurality of loudspeakers can include $N_q$ loudspeakers. Accordingly, determining the overall minimum value of the Lagrangian may include the step of determining an eigenvalue equation resulting in $N_q$ solutions.

At step 415, the method 400 may further include selecting, via the processor, a finite impulse response (FIR) filter set associated with a plurality of loudspeakers. This step may include determining a solution of the plurality of solutions corresponding to a largest eigenvalue. In other aspects, this step may further include determining an overall minimum value of the Lagrangian and selecting at least one criterion of a criterion set that can include, for example, determining a first solution that provides a highest average sound level in the bright zone, determining a second solution that provides a highest difference in dB between a bright zone acoustic level and a dark zone acoustic level, and/or determining a best fit pressure wave solution that identifies a bright zone pressure waveform having a minimal difference from a bright zone pressure wave produced with the single loudspeaker.

At step 420, the method 400 may further include generating, via the plurality of loudspeakers and based on the FIR filter set, an acoustic signal having a combined loudspeaker sound pressure value p at an observation point r in in the bright zone sound field. According to one or more embodiments, the combined loudspeaker sound pressure p at the observation point r is approximately equal to a unity acoustic energy at the observation point when the aggregated loudspeaker gain value is generated via a single loudspeaker of the plurality of loudspeakers, and the remaining loudspeakers of the plurality of loudspeakers are off.

It will be appreciated that multiple audio streams may be filtered by different FIR filter sets and simultaneously played through the same loudspeakers. Accordingly, we can deliver multiple audio streams to the same bright zone, each seeming to originate from a different location. Surround sound technologies can use these multiple streams to deliver the impression of sound that is emanating from a moving source. Stereo signals can similarly be delivered to the bright zone with the left and right channels seeming to originate from different directions.

Other embodiments may use multiple audio streams filtered by their own respective FIR filter sets and simultaneously played through the same loudspeakers. Accordingly, we can deliver one audio stream to a bright zone at the driver seat with a dark zone at the passenger seat while simultaneously delivering another audio stream to a bright zone at the passenger seat with a dark zone at the driver seat.

Moreover, embodiments of the present disclosure may include FIR-type filters and/or FIR filter set(s). It should be appreciated that the functionality described herein may be carried out by electronic filters which may include one or more FIR filters and or other types of filters known in the art.

At the same time an observer in the dark zone may hear low volume acoustic signals or hear nothing at all (e.g., the sound pressure due to the combined loudspeakers approaches zero in the dark zone).

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

Further, where appropriate, the functions described herein can be performed in one or more of hardware, software, firmware, digital components, or analog components. For example, one or more application specific integrated circuits (ASICs) can be programmed to carry out one or more of the systems and procedures described herein. Certain terms are used throughout the description and claims refer to particular system components. As one skilled in the art will appreciate, components may be referred to by different names. This document does not intend to distinguish between components that differ in name, but not function.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Computing devices may include computer-executable instructions, where the instructions may be executable by one or more computing devices such as those listed above and stored on a computer-readable medium.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A method comprising:

determining, via a processor, a bright zone comprising a high acoustic energy sound delivery region and a dark zone comprising a low acoustic energy sound delivery region;

selecting, via the processor, a finite impulse response (FIR) filter set associated with a plurality of loudspeakers; and generating, via the plurality of loudspeakers and based on the FIR filter set, an acoustic signal having a sound pressure due to combined loudspeakers at an observation point in the bright zone, wherein the sound pressure due to the combined loudspeakers at the observation point is approximately equal to a unity acoustic energy at the observation point when the sound pressure due to the combined loudspeakers is generated via a single loudspeaker of the plurality of loudspeakers.

2. The method according to claim 1, further comprising producing the FIR filter set, wherein producing the FIR filter set comprises:

generating a bright zone transimpedance matrix $Y_B$.

3. The method according to claim 2, wherein the bright zone transimpedance matrix $Y_B$ is used to form an eigenvalue equation.

4. The method according to claim 3, further comprising producing the FIR filter set, wherein producing the FIR filter set comprises:

determining a first energy comprising total acoustic energy in the bright zone;

determining a second energy comprising total acoustic energy in the dark zone; and minimizing a differential value of the first energy and the second energy.

5. The method according to claim 4, wherein the bright zone transimpedance matrix $Y_B$ comprises a plurality of elements associated with the single loudspeaker, and wherein minimizing the differential value of the first energy and the second energy further comprises:

modifying the bright zone transimpedance matrix $Y_B$ by:

subtracting a matrix $q_s$;

forming a Lagrangian that adds the second energy to the first energy; and determining an overall minimum value of the Lagrangian.

6. The method according to claim 5, wherein determining the overall minimum value comprises:

determining a total power term indicative of a total power sent to the plurality of loudspeakers;

including the total power term in the Lagrangian; and determining, via the processor, the overall minimum value of the Lagrangian.

7. The method according to claim 6, wherein the plurality of loudspeakers comprises $N_q$ loudspeakers.

8. The method according to claim 7, wherein determining the overall minimum value of the Lagrangian comprises:

solving, via the processor, the eigenvalue equation resulting in $N_q$ solutions.

9. The method according to claim 8, wherein determining the overall minimum value of the Lagrangian further comprises:

selecting at least one criterion of a criterion set comprising:

determining a first solution that provides a highest average sound level in the bright zone;

determining a second solution that provides a highest difference in dB between a bright zone acoustic level and a dark zone acoustic level; and determining a best fit pressure wave solution that identifies a bright zone pressure waveform having a minimal difference from a bright zone pressure wave produced with the single loudspeaker.

10. The method according to claim 7, wherein the bright zone and the dark zone are in an interior cabin of a vehicle.

11. The method according to claim 1, wherein generating the acoustic signal comprises delivering the acoustic signal that changes from a first sound origination direction to a second sound origination direction.

12. A system, comprising:

a processor; and a memory for storing executable instructions, the processor programmed to execute the instructions to:

determine a bright zone comprising a high acoustic energy sound delivery region and a dark zone comprising a low acoustic energy sound delivery region;

select a finite impulse response (FIR) filter set associated with a plurality of loudspeakers; and generate, via the plurality of loudspeakers and based on the FIR filter set, an acoustic signal having a sound pressure due to combined loudspeakers at an observation point in the bright zone, wherein the sound pressure due to the combined loudspeakers at the observation point is approximately equal to a unity acoustic energy at the observation point when the sound pressure due to the combined loudspeakers is generated via a single loudspeaker of the plurality of loudspeakers.

13. The system according to claim 12, wherein the processor is further programmed to produce the FIR filter set, wherein the processor is further programmed to:

determine a first energy comprising total acoustic energy in the bright zone;

determine a second energy comprising total acoustic energy in the dark zone; and minimize a differential value of the first energy and the second energy.

14. The system according to claim 13, further wherein the processor is further programmed to:

produce the FIR filter set by generating a bright zone transimpedance matrix $Y_B$.

15. The system according to claim 14, wherein the bright zone transimpedance matrix $Y_B$ is used to form an eigenvalue equation.

16. The system according to claim 15, wherein the bright zone transimpedance matrix $Y_B$ comprises a plurality of elements associated with the single loudspeaker, wherein the processor is further programmed to minimize the differential value of the first energy and the second energy by executing the instructions to:

modify the bright zone transimpedance matrix $Y_B$ by:

subtracting a matrix $q_s$;

forming a Lagrangian that adds the second energy to the first energy; and determining an overall minimum value of the Lagrangian.

17. The system according to claim 16, wherein the processor is further programmed to determine the overall minimum value by executing the instructions to:

determine a total power term indicative of a total power sent to the plurality of loudspeakers;

include the total power term in the Lagrangian; and determine the overall minimum value of the Lagrangian.

18. The system according to claim 17, wherein the plurality of loudspeakers comprises $N_q$ loudspeakers.

19. The system according to claim 18, wherein the processor is further programmed to determine the overall minimum value of the Lagrangian by executing the instructions to:

solve an eigenvalue equation resulting in $N_q$ solutions.

20. A non-transitory computer-readable storage medium in a computing device, the computer-readable storage medium having instructions stored thereupon which, when executed by a processor, cause the processor to:

determine a bright zone comprising a high acoustic energy sound delivery region and a dark zone comprising a low acoustic energy sound delivery region;

select a finite impulse response (FIR) filter set associated with a plurality of loudspeakers; and generate, via the plurality of loudspeakers and based on the FIR filter set, an acoustic signal having a sound pressure due to combined loudspeakers at an observation point in the bright zone, wherein the sound pressure due to the combined loudspeakers at the observation point is approximately equal to a unity acoustic energy at the observation point when the sound pressure due to the combined loudspeakers is generated via a single loudspeaker of the plurality of loudspeakers.

* * * * *